United States Patent [19]

Whelan, Jr.

[11] Patent Number: 4,577,076

[45] Date of Patent: Mar. 18, 1986

[54] SWITCH GUARD ASSEMBLY

[76] Inventor: Russell Whelan, Jr., 5638 Miriam Rd., Philadelphia, Pa. 19124

[21] Appl. No.: 543,541

[22] Filed: Oct. 19, 1983

[51] Int. Cl.[4] ..... H01H 27/00

[52] U.S. Cl. ..... 200/294; 174/48; 200/296

[58] Field of Search ..... 200/294, 296, 297, 44; 174/48, 58; 220/3.9, 3.92, 3.3

[56] References Cited

U.S. PATENT DOCUMENTS

| | | | |
|---|---|---|---|
| 3,290,475 | 12/1966 | Bross | 200/294 |
| 3,356,819 | 12/1967 | Zavertnik et al. | 200/296 |
| 3,941,915 | 3/1976 | Boghosian | 200/296 |
| 3,965,629 | 6/1976 | Pearson | 174/48 |
| 4,099,020 | 7/1978 | Kohaut | 174/48 |
| 4,229,614 | 10/1980 | Smolik | 174/58 |
| 4,264,792 | 4/1981 | Gillette | 200/44 |

FOREIGN PATENT DOCUMENTS

| | | | |
|---|---|---|---|
| 294853 | 11/1967 | Australia | 200/296 |

*Primary Examiner*—Stephen Marcus
*Assistant Examiner*—Renee S. Kidorf
*Attorney, Agent, or Firm*—Caesar, Rivise, Bernstein & Cohen, Ltd.

[57] ABSTRACT

The switch guard assembly is comprised of an outer plate and a back plate. The switch guard assembly also involves a housing that is mounted against a panel, such as a cinderblock wall or a door jamb. The panel has inner and outer panel faces. The housing assembly is resistant to unauthorized access to the interior thereof. The outer plate and back plate are mounted respectively against the inner and outer panel faces. Both the outer plate and the back plate have openings. A cinderblock or door panel is provided with an opening that will eventually communicate with the openings of the outer and back plates. A pipe includes first and second ends located in the panel openings with the first pipe end passing through and beyond the opening in the outer plate. The second pipe end passes through and beyond the opening in the back plate.

2 Claims, 4 Drawing Figures

SWITCH GUARD ASSEMBLY

BACKGROUND OF THE INVENTION

This invention relates to a switch guard assembly and more particularly to a new and significantly different type of product for enhancing various security arrangements.

In many devices actuation is accomplished by a key switch which is usually mounted against a door jamb or against a cinderblock panel. For instance, key switches can be found in a variety of products, such as burgular alarms systems and garage door openers.

It has been determined that it is relatively easy for an unauthorized person to actuate a key switch. In most cases it is a relatively simply matter to pry the key switch or key switch housing away from the supporting surface, and then the switch can be easily acutated by an unauthorized person.

Accordingly, the present invention has for its objective the provision of a switch guard assembly which strongly resists attempts to gain unauthorized access.

Yet another object of the present invention is to provide a switch guard assembly that can be relatively simply mounted into place and yet which will afford sufficient resistance to anyone attempting to gain unauthorized access.

Still another object of the present invention is to provide a switch guard assembly constituting relatively few parts that can either be easily purchased at low cost or assembled at low cost.

The foregoing as well as other objects of the invention are achieved by providing a switch guard assembly that is comprised of an outer plate and a back plate. The switch guard assembly also involves a housing that is mounted against a panel, such as a cinderblock wall or a door jamb. The panel has inner and outer panel faces. The housing assembly is resistant to unauthorized access to the interior thereof.

The outer plate and back plate are mounted respectively against the inner and outer panel faces. Both the outer plate and the back plate have openings.

A cinderblock or door panel is provided with an opening that will eventually communicate with the openings of the outer and back plates. Pipe means with first and second ends are located in the panel openings with the first pipe end passing through and beyond the opening in the outer plate. The second pipe end passes through and beyond the opening in the back plate.

The first pipe end is firmly secured to the outer plate and the second pipe end is firmly secured to the back plate.

An electrical switch means is located within the housing assembly and is wired through the pipe means and openings in the plate. The switch means is wired to a source of power such that firm securement of the pipe ends to the outer plate and the back plate resists removal of the housing from its position against the outer panel face. Thus, it is very difficult to quietly pry or otherwise quietly separate the cylinder housing from its mounted position against the cinderblock or door.

The foregoing as well as other objects of the invention well become readily apparent by reference to the attached drawings wherein.

Figure 1:
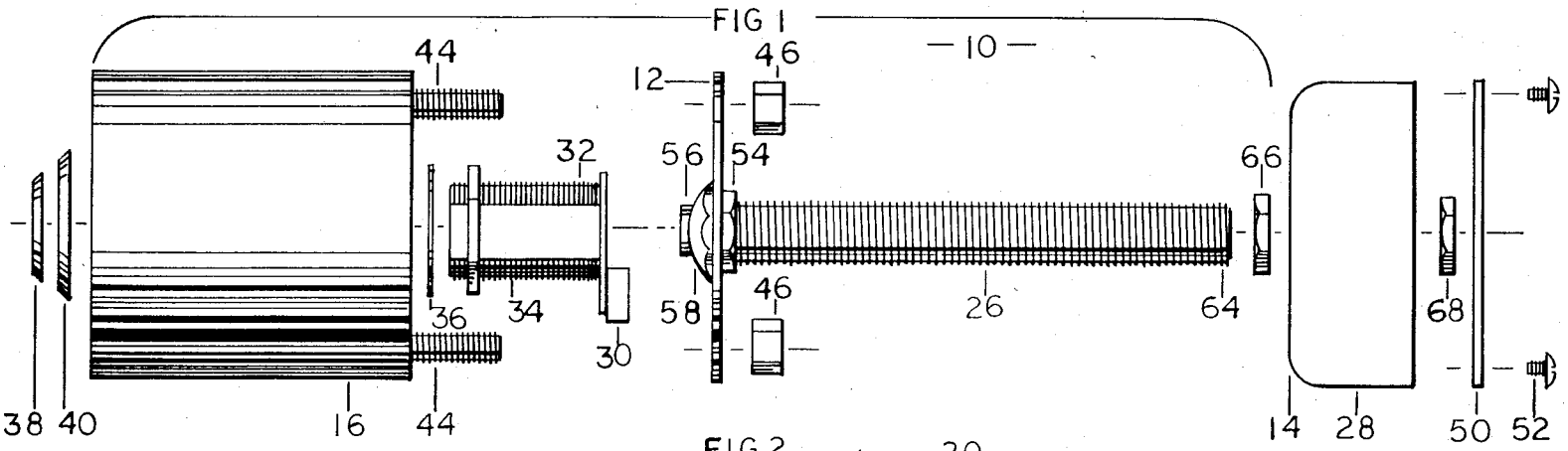
FIG. 1 is an exploded view showing an embodiment of the switch guard assembly of the present invention.
Figure 4:
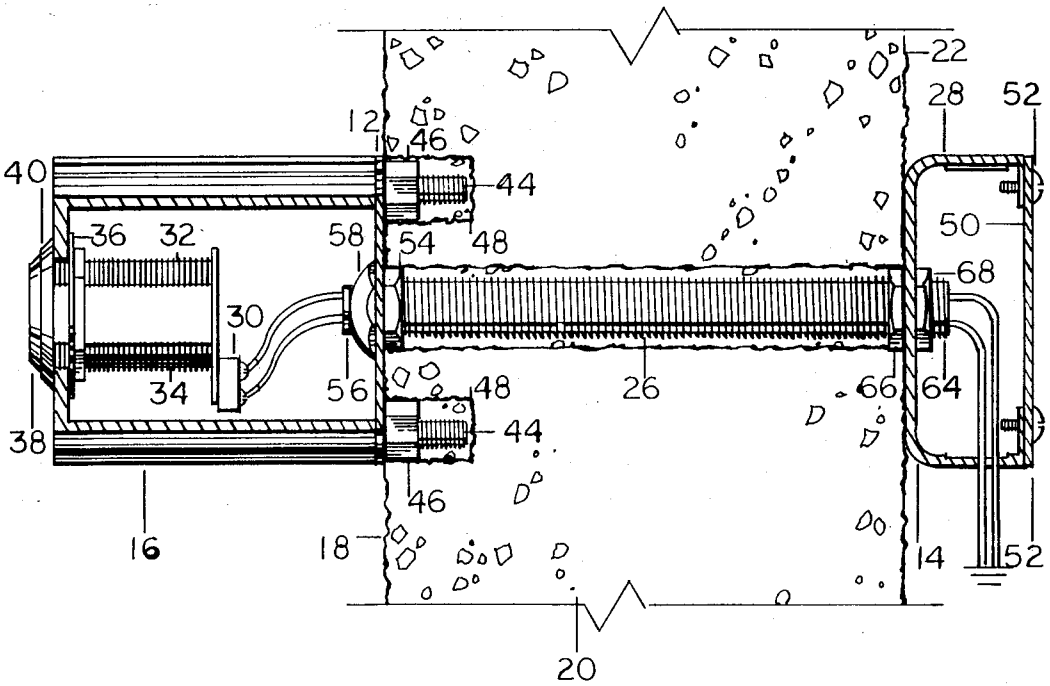
FIG. 4 is a sectional view taken along the lines 4—4 of FIG. 3.
Figure 3:
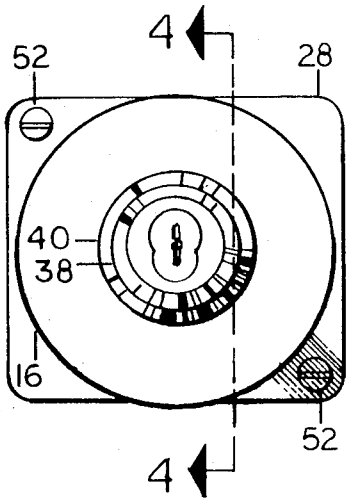
FIG. 3 is a partial front elevational view.

Referring now in greater detail to the various figures of the drawing wherein like reference characters refer to like parts, there is shown at 10 in FIG. 1 a switch guard assembly constituting an embodiment of the present invention. The switch guard assembly 10 includes an outer plate 12 and a back plate 14. In comparing FIGS. 1 and 2 it can be seen that the outer plate 12 is positioned against outer panel face 18 of panel 20, such as cinderblock as indicated in FIG. 1. The panel 20 also has an inner panel face 22 (FIG. 4) against which back plate 14 is mounted (FIG. 4). As further seen in FIG. 4 the back plate 14 in the preferred embodiment is actually the rear wall of a standard electrical box. All of the foregoing are made of metal or plastic.

Figure 2:
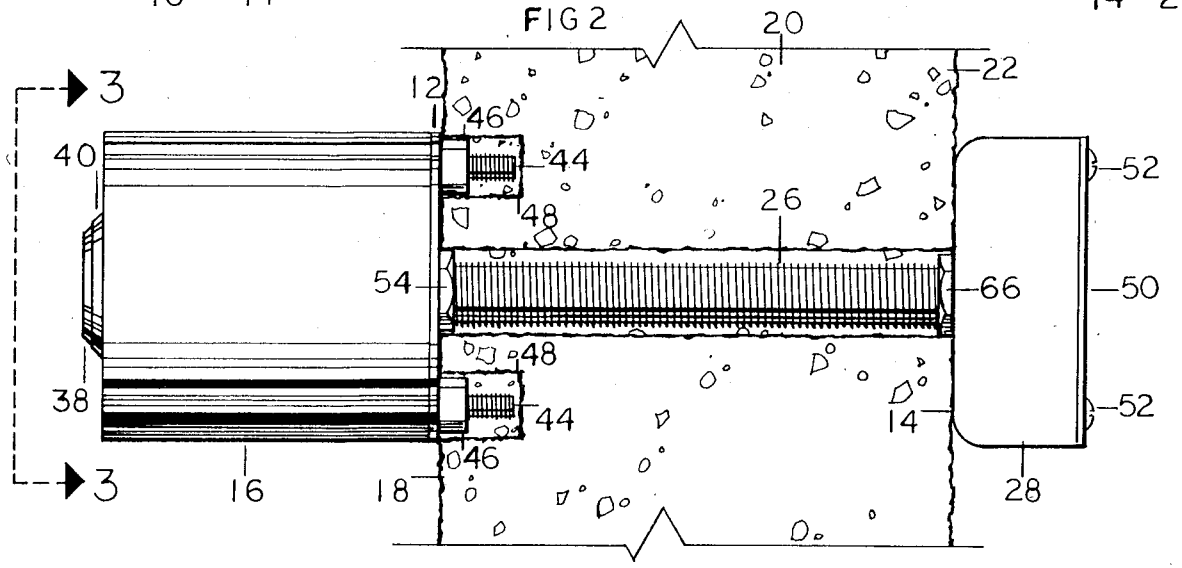
FIG. 2 is an elevational view, partly in section, showing the switch guard assembly of FIG. 1 in an assembled condition.

As will be appreciated from FIG. 2 both the outer plate 12 and the back plate 14 have openings formed therein.

With reference to FIG. 1 it can be seen that a central hole is drilled in the cinderblock panel 20 to receive pipe means 26. While the term "pipe means" is used in the claims, it is to be understand that "pipe means" includes any metallic or plastic pipe or any other type of annular structure. The annular opening of the pipe 26 is placed in communication with the openings in outer plate 12 and back plate 14 to permit communication of insulated electrical wires with the interior of housing assembly 16 and beyond to electrical box 28 as shown in FIG. 4.

The housing assembly 16 is so constructed as to be resistant to unauthorized access to the interior thereof. The housing 16 is made of heavy metal which is welded together or otherwise strongly jointed so as to require heavy blows or loud piercing mechanisms in order to obtain unauthorized access.

The electrical switch means 30 are contained within housing 16 as indicated in FIGS. 2 and 4. The switch means shown are so-called electrical keying means or otherwise actuated by a key. The particular lock assembly 32 is best shown in FIG. 4 as comprising threaded lock cylinder 34, the outer ends of which pass through an opening in front wall of the housing assembly 16. Inner and outer threaded nuts 36 and 38 securely hold the key plate 40 and lock cylinder 34 in place. The cylinder 34 (FIG. 4) is actuated by the turning of the key in a manner well known in the lock art.

The housing 16 is secured to the outer plate 12, or panel 20 by means of bolts 44 passing through openings in the outer plate 14, with nuts 46 being tightened to secure the outer plate 14 against the housing 16. Holes 48 are tapped in the cinderblock panel 20 to receive the nut and bolt stems. In the preferred embodiment outer plate 12 closes the open end of housing 16.

A standard electrical box 28 (the type of box typically usable by an electrician complying with applicable building codes) is provided with a rear wall that constitutes the back plate 14. The box 28 is closed by means of plate 50 being held against the box 24 by threaded bolts or screws 52 in a manner well known to the art.

Both the housing 16 and the box 28 are tightly and securely held against the outer and inner faces 18 and 22 respectively of the panel 20 by means of certain connections in conjunction with the pipe 26. As shown in FIG.

2 the outer or first end of the pipe 26 is threaded and a nut 54 is positioned on a first pipe end 56. The threaded first pipe end 56 passes through an opening in the outer plate 12 with a dome-like cap 58 being welded to both the first pipe end 56 (which is swaged over) and the outer face of the outer plate 12 (FIG. 1). The nut 54 may be adjusted so as to be tightly positioned against the inner face of the outer plate 12.

Once the electrical key lock 32 is installed in the housing 16, the outer plate 12 with its attached pipe 16 is brought against the rear open portion of the housing 16, and the nut 54 is tightened so that the outer plate 12 is held tightly against the housing 16. The combined pipe 26 and outer plate 12 are then secured to cylindrical housing 16 (containing lock assembly 32 and tightly sealed) by using threaded bolts whose stems 44 can be seen in FIGS. 1 and 4. Nuts 46 are then tightened on stems 44 to secure outer plate 12 (with pipe 26) to the housing 16. This sub-assembly is then secured in place so that the pipe 26 is positioned within the opening in the cinderblock panel 20.

In the aforesaid position of FIGS. 2 and 4, the inner face of outer plate 12 is flush against the outer wall of the cinderblock panel 20. In this position the second end 64 of the pipe 26 extends though the opening in back plate 14 of the electrical box 28. This second end 64 is also threaded. A first nut 66 is threadedly engaged near the second end of a pipe 26 and outwardly of back plate 14. The extreme free second end 64 passes through an opening in back plate 14 and a second nut 68 is then tightened against back plate 14 and nut 66. Such tightening draws the pipe 26 toward the electrical box 28 and in so doing also tightly draws or forces the housing 16 to be firmly mounted against the outer face 18 of the cinderblock panel 20.

From the foregoing it can be seen that highly destructive or noisy types of tools are required to separate the housing 16 from the cinderblock wall 20. This is because the engagement of the pipe 26 in the electrical box 28 on the inner side of the panel 20 strongly resists quiet and artful attempts to separate or pry housing 16 from the cinderblock wall 20.

In view of the foregoing it is clear that unauthorized access to the electrical key switch mechanism is made considerably more difficult as compared with the relatively easy removal and actuation of many electrical key switches associated with security devices now in use.

Without further elaboration, the foregoing will so fully illustrate my invention that others may, by applying current or future knowledge, readily adapt the same for use under various conditions of service.

I claim:

1. A switch guard assembly for mounting on a panel, said switch guard assembly comprising an outer plate and a back plate, said switch guard assembly further including a housing assembly, said panel having inner panel and outer panel faces, said outer plate and back plate being mounted respectively against said outer and inner panel faces, said outer plate being secured to said housing assembly and having an opening, said back plate being the rear wall of a standard electrical box and having an opening, said securement of said outer plate being accomplished by backwardly extending bolts which pass through appropriate openings in the outer plate, with the outer plate being secured in place by nuts threaded on said bolts, and wherein portions of said bolts and nuts are located in holes drilled in said panel, said panel having an opening communicating with the openings in said outer and back plates, a pipe having first and second ends, said pipe being located in said panel opening with said first pipe end passing through and beyond the opening in said outer plate and the second pipe end passing through and beyond the opening in said back plate, said first pipe end being firmly secured to said outer plate in a cap that is firmly secured to said first pipe end and said outer plate and said second end being firmly, but releasably, secured to said back plate, said housing assembly having in its interior, electrical switch means located in said housing and wired through said pipe and openings in said plates, said switch means being wired to a source of power, whereby the firm securement of said pipe ends to said outer plate and back plate resists removal of said housing from its position against said outer panel face, thereby further resisting access to said electrical switch means.

2. The switch guard assembly of claim 1 wherein said first pipe end extends through said outer plate to a dome-like cap that is welded to both the first pipe end and the outer face of the outer plate.

* * * * *